US005222935A

United States Patent [19]

Schlarb

[11] Patent Number: 5,222,935

[45] Date of Patent: Jun. 29, 1993

[54] CENTRIFUGE WITH A SCREW AND BRISTLES FOR SEPARATING A SUSPENSION INTO A SOLIDS PHASE AND AT LEAST ONE LIQUID PHASE

[75] Inventor: Manfred Schlarb, Vilsbiburg, Fed. Rep. of Germany

[73] Assignee: Flottweg GmbH, Vilsbiburg, Fed. Rep. of Germany

[21] Appl. No.: 900,158

[22] Filed: Jun. 17, 1982

[30] Foreign Application Priority Data

Jun. 21, 1991 [DE] Fed. Rep. of Germany ..... 4120565

[51] Int. Cl.[5] ..... B04B 1/20

[52] U.S. Cl. ..... 494/54; 198/659; 210/380.3; 366/319; 366/322; 494/53

[58] Field of Search ..... 366/186, 196, 318–319, 366/322; 494/43, 50–55, 67, 68, 85; 210/360.1, 380.1, 380.3, 377; 198/657, 659, 670, 676

[56] References Cited

U.S. PATENT DOCUMENTS

| | | | |
|---|---|---|---|
| 165,228 | 7/1875 | Gent | 366/319 |
| 692,011 | 1/1902 | Hansen | 366/319 X |
| 1,417,965 | 5/1922 | Belcher | 366/319 X |
| 1,529,750 | 3/1925 | Plate | 210/377 X |
| 2,184,598 | 12/1939 | Jahn | 494/53 X |
| 3,644,103 | 2/1972 | Yoon et al. | 210/194 X |
| 4,243,779 | 1/1981 | McAlister | 366/319 X |

FOREIGN PATENT DOCUMENTS

| | | | |
|---|---|---|---|
| 324335 | 3/1903 | France | 494/85 |
| 1174088 | 8/1985 | U.S.S.R. | 494/53 |

*Primary Examiner*—Harvey C. Hornsby
*Assistant Examiner*—Charles Cooley
*Attorney, Agent, or Firm*—Max Fogiel

[57] ABSTRACT

Centrifuge for the separation of a suspension into a solids phase and at least one liquid phase, especially decantering centrifuge with separator following in alignment, full-jacket screw centrifuge or the like with screw (2) rotating at differential speed of rotation from its jacket (1), the helices (4) of which fit close against the course of the inner surface of the jacket, which narrows conically over at least some of its axial section looking toward the solids outlet (13) in particular, and between which, the hub (3) of the screw, and the jacket (1) is left the separation section (6), into which the suspension is injected, especially through a cavity (10 & 11 or 10 & 12) in the hub (3) of the screw. To increase the quality and quantity of the separation and hence save time and material, longish structures (7 or 8) like threads or bristles are provided at least over a partial section of the longitudinal extent of the hub (3) of the screw distributed around its circumference, yielding transversely to their longitudinal extent to the attack of coarser solids particles and centrifugally straightening more or less radially out from the hub and extending into the separation section (6) subject to the action of centrifugal force as the centrifuge operates.

14 Claims, 4 Drawing Sheets

CENTRIFUGE WITH A SCREW AND BRISTLES FOR SEPARATING A SUSPENSION INTO A SOLIDS PHASE AND AT LEAST ONE LIQUID PHASE

BACKGROUND OF THE INVENTION

The invention concerns a centrifuge for the separation of a suspension into a solids phase and at least one liquid phase, especially decantering centrifuge with separator following in alignment, full-jacket screw centrifuge or the like with screw rotating at differential speed of rotation from its jacket, the helices of which fit close against the course of the inner surface of the jacket, which narrows conically over at least some of its axial section looking toward the solids outlet in particular, and between which, the hub of the screw, and the jacket is left the separation section, into which the suspension is injected, especially through a cavity in the hub of the screw.

Centrifuges for separating what is called a suspension, a liquid that contains solid matter, into a solids phase and one or more liquid phases are known. The suspension is accelerated inside the centrifuge's rotating jacket, forcing the solids, which are heavier than the clear liquid, to settle against the inner surface of the jacket. The solids as a rule comprise many particles that differ in size and/or weight. Although the coarse and heavy particles will precipitate readily, the difficulty and trouble of inducing them to do so increases with their decrease in size and weight. To attain desirable separating results, accordingly, attempts have naturally been made to separate finer and finer solids particles in order to extract a purer and purer clear liquid and increase the amount of solids extracted or, in brief, to optimize the separating results.

SUMMARY OF THE INVENTION

The object of the invention is to improve centrifuges of the aforesaid type with respect to the quality and quantity of their separating results, especially in terms of conserving time and material.

This object is attained in accordance with the invention in that longish structures like threads or bristles are provided at least over a partial section of the longitudinal extent of the hub of the screw distributed around its circumference, yielding transversely to their longitudinal extent to the attack of coarser solids particles and at the latest centrifugally straightening more or less radially out from the hub and extending into the separation section subject to the action of centrifugal force as the centrifuge operates.

The aforesaid problematics and the attempts to achieve as satisfactory separation as possible common to all centrifuge 19 concepts concerned with the separating objectives addressed herein and accordingly accessible to the present approach will now be discussed with respect to the particularly preferred embodiment of a completely enclosed helical centrifuge by way of example, without, however, limiting the object and its means of attaining it to the operation of that centrifuge. Again, it is basically a centrifuge without a mechanism (screw) of the conveying the solids that is being addressed. Nor does it matter whether separation results in one or more solids components and clear-liquid components.

Orienting the longish structures like threads or bristles out from the hub of the screw and securing them more or less directly to it will ensure more satisfactory separation of even the finest particles, which will accumulate on the surface of the structures and can hence more effectively and/or rapidly separate from the liquid along the threads and join any solids already precipitated on the inner surface of the centrifuge's jacket. The result is primarily more extensive separation than previously possible. The material that the longish structures are made of will depend to some extent on how effectively they will "collect or intercept" the finer and finest solids. Their cross-section or even longitudinal section can be differentiated in shape and optionally adapted to the separation job, the simplest shape being a continuous circle. Strips and/or longitudinally tapering cross-sections are also conceivable.

The longish structures will promote the requisite acceleration of the liquid in the direction of rotation, especially where or near where the suspension enters, which also improves the separation results in that the turbulence that would occur in those regions without the structures would be detrimental to precipitation of the solids.

From this background it will be evident that the longish structures can basically be so developed spring-elastically, that they will be to such an extent rigid in the sense of elevating their entrainment property in the sense of acceleration of the suspension in the direction of rotation, that they will automatically, without, that is, the application of centrifugal force, assume their radially outward centrifugal linearity from the hub of the screw. The structures will in that event have the character of correspondingly spring-elastic bristles. It is especially, however, outside the vicinity of the suspension intake, where the clarifying of finer solids particles is of major importance, that an especially preferred embodiment of the longish structures will be in the manner of threads with no recuperative elastic properties, so that they will not straighten out and extend into the separation section and hence into the pool until subject to the centrifugal force that occurs when the centrifuge is in operation. Between these two embodiments, bristle and thread, there exists a full transitional range of potentially applicable longish structures, nor should threads and bristles be understood as implying that a setiform structural character must necessarily be present in the vicinity of the intake and a filiform in the clarified region outside the intake. Either a bristle-like and spring-elastic embodiment of the longish structures can very well be consistently present or just as consistently a filiform structure. It is preferable to employ different structures, of a bristle-like character in the intake vicinity and of a filiform character in the separation area outside the intake. In another preferred embodiment, finally, a continuous or discontinuous change in rigidity from the suspension intake and through the separation section is possible. Again, the structures do not have to extend along the whole hub, but may surround subsidiary section, such as from the suspension intake to at least near the solids outlet. The range of potentials will be exploited in particular with reference to the type of centrifuge, the parallel-current and countercurrent principle in the present case. Furthermore, the teaching in accordance with the invention is independent of whether the screw has one helix or more.

When the helix is continuous, the liquid will theoretically travel between adjacent helices and will accordingly travel a relatively long sidementation section before it reaches the clear-liquid outlet, although it will tend due to the decrease in pressure from helix to helix to wash away the lower surface of the helix, to flow, that is, between the outer edge of the helix and the adjacent inner surface of the jacket. Any fine solids precipitated there will simultaneously be swirled up again. In one particularly preferred embodiment of the invention accordingly, the screw's helix is discontinuous in that vicinity, especially in the clarification area averted from the solids outlet in countercurrent centrifuges, especially between the suspension intake and the clear-liquid outlet, and specifically such that the liquid can flow with a powerful axial component, while supporting the helix in its purpose of forwarding the solids to the extent that its axial off-conveying route is not interrupted. There will be no gaps along the screw and hence in the direction the solids are being conveyed in between the helical sections created by the interruption in the helix and mutually displaced along the screw, and the helices can even overlap to some extent, so that forwarding the solids can be continued only discontinuously from one helical section to the next. The threads, which basically can be of any material, preferably plastic tensionally loadable plastic, or filiform nylon, that is strong enough to resist the centrifugal forces and solids-particle impacts occurring in the present context, exhibit enough lateral flexibility to allow the longish structures to yield to coarser particles and prevent clogging. This is just as true of the spring-elastic and bristle-like versions as it is of those that have no inherent linear stability and accordingly do not straighten out filiform until subjected to the effects of centrifugal force, being accordingly especially able to react flexibly subject to the attack of coarser solids particles and prevent clogging. The attachment of the longish structures to the hub of the screw is basically of any type and can also be oriented to holders that are not subject to rotation or centrifugal force in relation to the hub. A loop shape is so provided for filiform structures in particular that the midsection is secured to the hub of the screw or to the holder and both centrifugally straight-outward forced sections extend into the separation section in the capacity of two longish structures.

These and other preferred embodiments of the invention will be evident from the subsidiary claims, especially with reference to the embodiments reproduced by way of example in the drawing, the following description of which will explain the invention in more detail.

DESCRIPTION OF THE PREFERRED EMBODIMENTS

Figure 2:
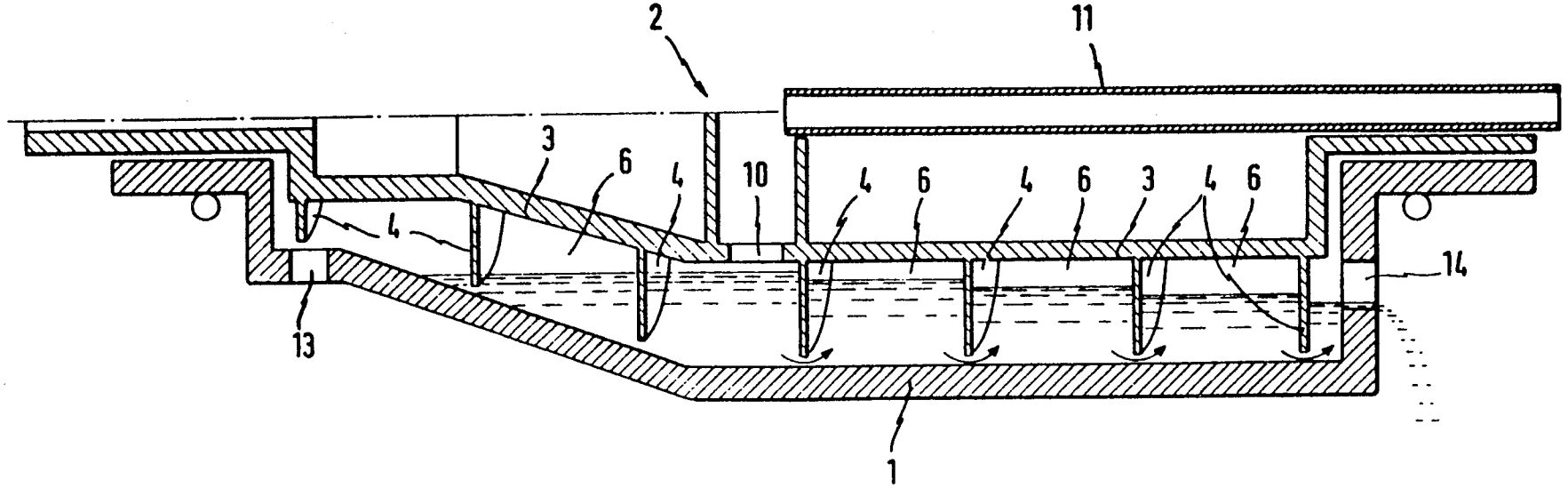
FIG. 2 is a schematic longitudinal section through a centrifuge in a half-wise representation with respect to the axis of rotation to illustrate the decrease in pool pressure inside the separation section.

The figures illustrate embodiments by way of example of completely enclosed helical centrifuges or their screws of a basically known design with a jacket 1 and a screw 2 that is so driven at a differential speed of rotation in relation to the rapid-running driven jacket 1, that the plastic that precipitates on the inner surface of the jacket is forwarded in accordance with the pitch of the helix 4, which is developed extending off the outer surface of the hub 3 of the screw, by the helix 4 to the solids outlet 13. As will be evident from FIG. 2 in particular, a gradient becomes established in the levels of the suspension supplied through the inlet opening 10 from a supply cavity in the screw's hub in the separation section 6 constituted between the helices 4, the hub 3, and the jacket 1, so that the radial power of the pool decreases as viewed departing from the suspension-inlet opening 10 for the clear-liquid outlet 14. Due to the accordingly resulting pressure difference between adjacent helical passages a certain flow becomes established between the radially outer edges of the helix and the inner surface of the jacket, through which some of the solids that have precipitated there can be swirled up again.

Figure 1:
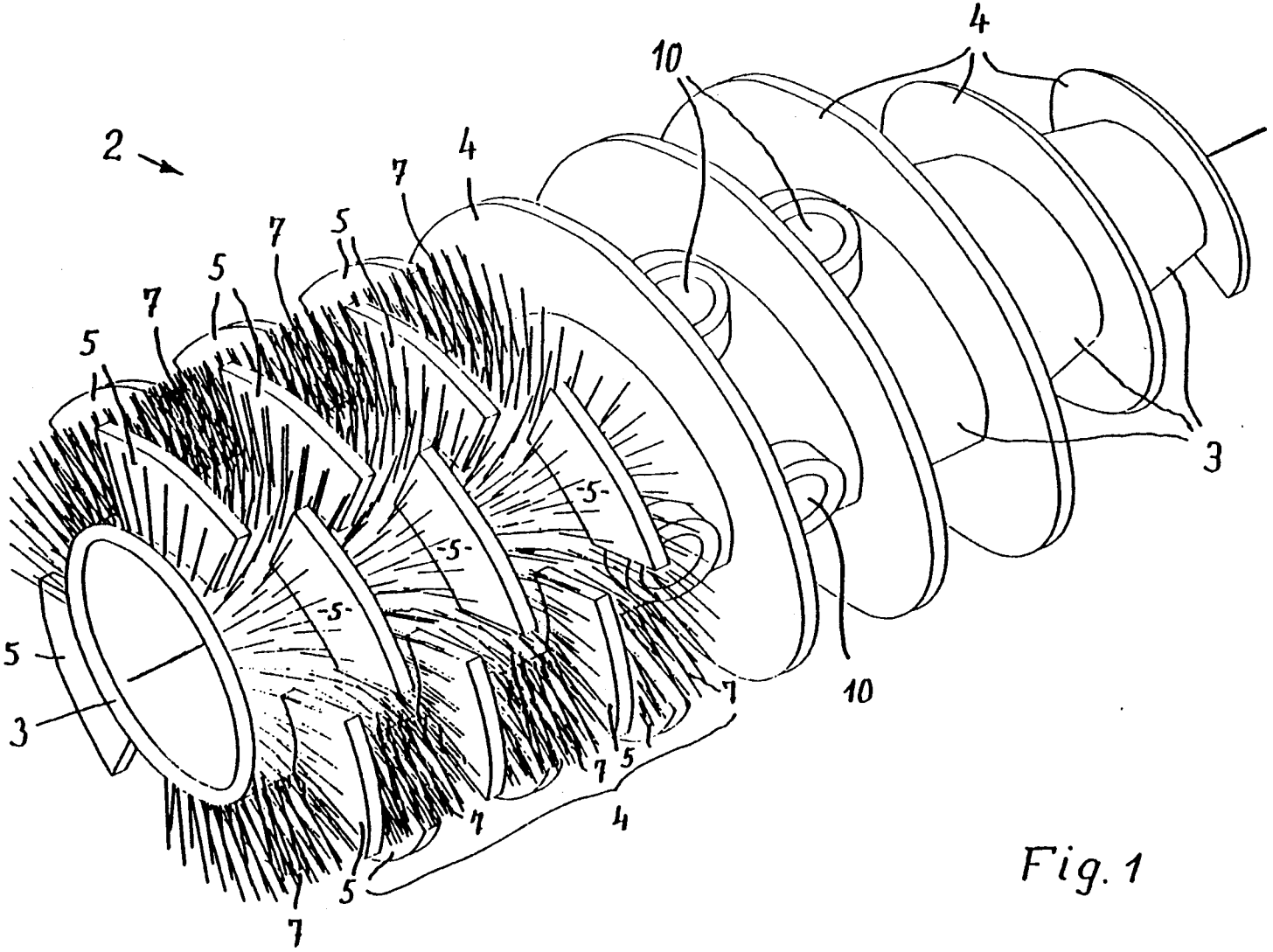
FIG. 1 is a perspective view of one embodiment by way of example of a screw with longish structures positioned within one section.

For this reason, in the embodiment in accordance with FIG. 1, the helix of the screw 2 there represented is developed so discontinuous in the axial section between the suspension-inlet openings 10 and the terminal section facing the conically tapering end associated with the solids outlet as to result in helical sections 5 mutually displaced in axial direction but leaving no gaps free in that direction, so that the solids to be conveyed by the helical sections can be transported accordingly step by step. The discontinuous design of the helices 4 in sections 5 in this axial helical section, however, provides an axial channel for the liquid to flow through between the sections, so that the washing away below the radially outer edges of the helices delineated with reference to FIG. 2 will not take place to the extent that the pressure equalization occurs through axial flow.

In the embodiment illustrated by way of example in FIG. 1, the section of the screw with a discontinuous helical design is simultaneously provided as viewed off along the circumference of the screw hub with a multiplicity of longish structures 7 of filiform character. Since it is a question here of the clear stretch of a countercurrent centrifuge outside the suspension intake, the occurrence of finer solids particles here is correspondingly preponderant —the coarser precipitate in or near the vicinity of the intake—so that here the filiform structures especially must fulfill their task of collecting fine solids and must accordingly really be fine, preferably becoming finer looking toward the clear-liquid outlet.

Figure 3:
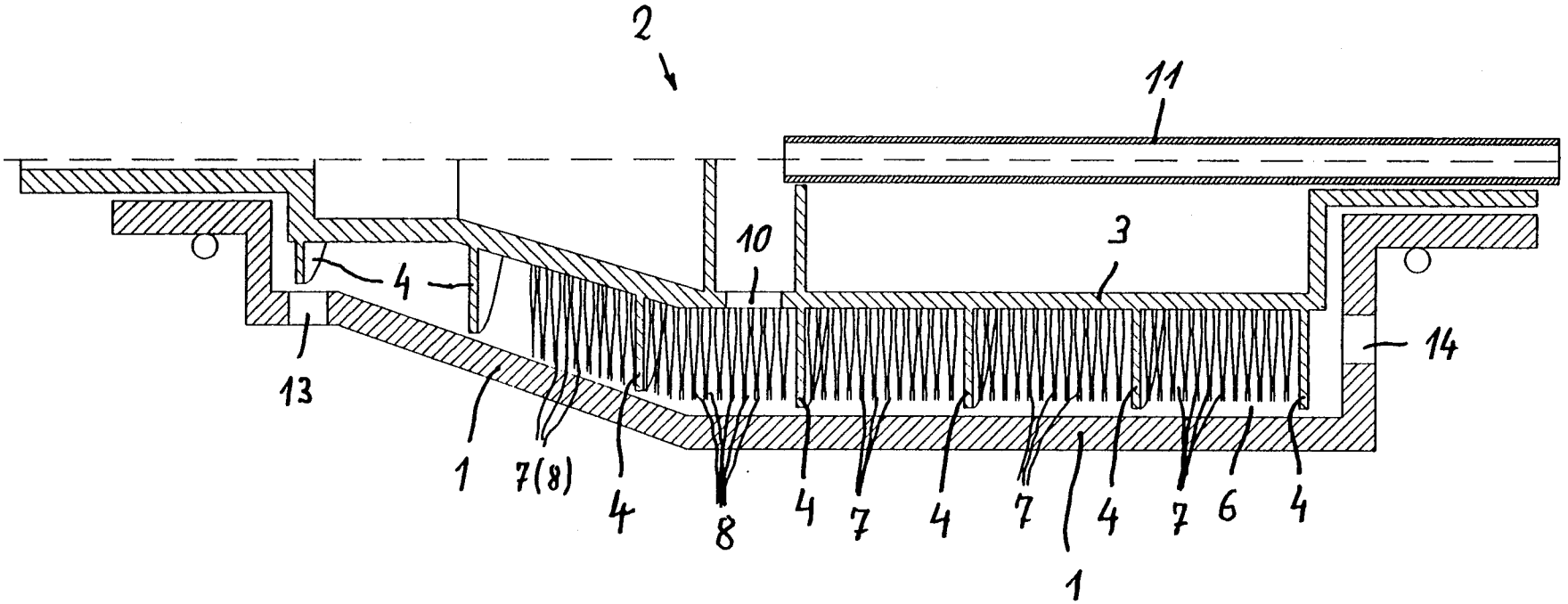
FIG. 3 is a schematic longitudinal section through a completely enclosed countercurrent-principle helical centrifuge corresponding in representation to FIG. 2.
Figure 4:
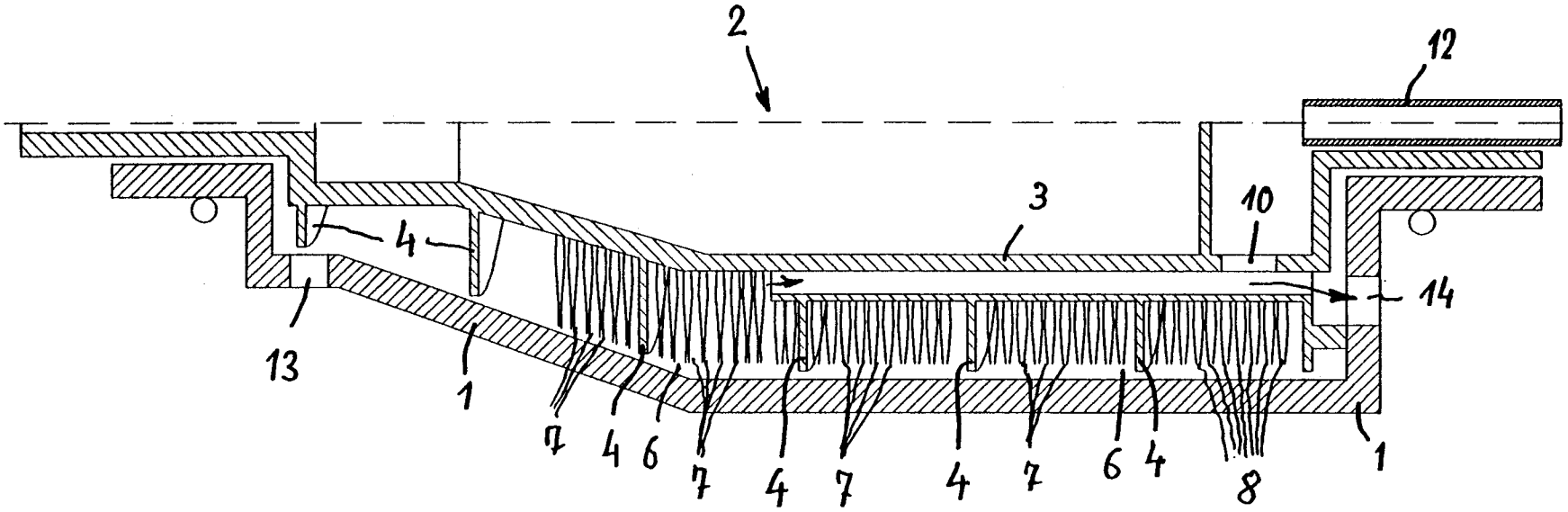
FIG. 4 is a schematic longitudinal section through a completely enclosed parallel-current principle helical centrifuge corresponding in representation to FIG. 2.

In the embodiments illustrated by way of example in FIGS. 3 and 4, the longish structures 7 and 8 extend so far out over the total clear section or end in the conically tapering section of the jacket in front of the solids outlet 13. FIG. 3 illustrates the principle of a countercurrent centrifuge, meaning that the suspension is introduced through an inlet pipe 11 into the longitudinal midsection of the screw's hub, where it is injected into the separation section 6 through inlet openings 10, so that the solids of a coarser nature that precipitate in the vicinity of the intake are conveyed a short distance to the solids outlet 13, whereas the finer solids precipitating in the section between the inlet 10 and the clear-liquid outlet 14 above all will be forced to take the correspondingly longer route. With the countercurrent centrifuge in accordance with FIG. 4 the suspension is injected through the intake pipe 12 and corresponding inlet openings 10 at the beginning of the overall forwarding stretch of screw 2, so that the solids precipitating in the vicinity of the intake must travel a corresponding long transport route. The clarified liquid is released in the screw's longitudinal midsection and conveyed to the clear-liquid outlet 14. Both models are known and need no further description here.

In the vicinity of the particular suspension intake—inlet openings 10—the incoming suspension must be accelerated, which has until now been ensured in this vicinity of the inner surface of the jacket. The purpose of the longish structures 8 now positioned in this area in the vicinity of the intake in accordance with FIGS. 3 and 4 is mainly acceleration and they are accordingly executed more rigid than outside that vicinity. One can provide here a setiform structure, meaning one that will straighten itself out radially subject to spring elasticity, whereas filiform structures can be positioned in the remaining section of separation section, especially in the vicinity of the clear-liquid outlet. The entraining action of the longish structures in the vicinity of the suspension intake has a particularly beneficial effect as well in that the inner surface of the jacket, which otherwise ensures the acceleration, is protected with respect to its abrasion in this vicinity.

What is claimed is:

1. A decantering centrifuge for separating a suspension into a solids phase and at least one liquid phase, comprising: a jacket; a screw rotating at differential speed of rotation from said jacket; said screw having helices fitting closely against an inner surface of said jacket; said jacket having an axial section extending toward a solids outlet of said jacket, said jacket narrowing conically over at least a part of said axial section; said screw having a hub, said suspension being introduced into a separation section between said hub and said jacket through an inlet opening in said hub, said hub having a longitudinal section; elongated bristle-type flexible elements on at least a part of said longitudinal section of said hub and distributed about a circumference of said hub; said flexible elements yielding transversely to solids particles striking said flexible elements, said flexible elements tending to be straightened radially by centrifugal action due to rotation of said hub, and extending into said separation section due to said centrifugal action.

2. A decantering centrifuge as defined in claim 1, wherein said flexible elements assume a straight-line shape around said circumference of said hub due only to said centrifugal action.

3. A decantering centrifuge as defined in claim 2, wherein said flexible elements are tensionally loadable plastic.

4. A decantering centrifuge as defined in claim 3, wherein said flexible elements are filiform nylon.

5. A decantering centrifuge as defined in claim 1, wherein said flexible elements are elastic.

6. A decantering centrifuge as defined in claim 1, wherein said helices are interrupted by gaps; sectional elements corresponding to said gaps being displaced axially from said gaps on said hub and facing said gaps, said sectional elements having a length at least as long as the length of said gaps measured along the circumference of said hub.

7. A decantering centrifuge as defined in claim 6, wherein the length of said sectional elements exceeds the length of said gaps so that ends of said sectional elements overlap ends of said gaps around the circumference of said hub.

8. A decantering centrifuge as defined in claim 1, wherein said longitudinal section of said hub is located between said inlet opening and said solids outlet, said flexible elements being confined to said longitudinal section.

9. A decantering centrifuge as defined in claim 8, wherein said flexible elements terminate in front of said solids outlet at a spaced distance from said solids outlet.

10. A decantering centrifuge as defined in claim 1, including auxiliary elongated elements positioned adjacent said inlet opening and having a rigidity exceeding the rigidity of said flexible elements.

11. A decantering centrifuge as defined in claim 1, wherein said jacket has a liquid phase outlet, said flexible elements having a flexibility that increases toward said liquid-phase outlet.

12. A decantering centrifuge as defined in claim 1, wherein said flexible elements are comprised of loop-shaped members with a midsection secured to said hub, said flexible elements being formed by portions of said loop-shaped members extending away from said midsection.

13. A decantering centrifuge as defined in claim 1, wherein said flexible elements comprise elastic bristles adjacent said inlet opening and comprise further flaccid threads at locations axially spaced from said elastic bristles.

14. A decantering centrifuge for separating a suspension into a solids phase and at least one liquid phase, comprising: a jacket; a screw rotating at differential speed of rotation from said jacket; said screw having helices fitting closely against an inner surface of said jacket; said jacket having an axial section extending toward a solids outlet of said jacket, said jacket narrowing conically over at least a part of said axial section; said screw having a hub, said suspension being introduced into a separation section between said hub and said jacket through an inlet opening in said hub, said hub having a longitudinal section; elongated bristle-type flexible elements on at least a part of said longitudinal section of said hub and distributed about a circumference of said hub; said flexible elements yielding transversely to solids particles striking said flexible elements, said flexible elements tending to be straightened radially by centrifugal action due to rotation of said hub, and extending into said separation section due to said centrifugal action; said flexible elements assuming a straight-line shape around said circumference of said hub due only to said centrifugal action; said flexible elements being elastic; said helices being interrupted by gaps; sectional elements corresponding to said gaps being displaced axially from said gaps on said hub and facing said gaps, said sectional elements having a length at least as long as the length of said gaps measured along the circumference of said hub; said length of said sectional elements exceeding the length of said gaps so hat ends of said sectional elements overlap ends of said gaps around the circumference of said hub; said longitudinal section of said hub being located between said inlet opening and said solids outlet, said flexible elements being confined to said longitudinal section; said flexible elements terminating in front of said solids outlet at a spaced distance from said solids outlet; auxiliary elongated elements positioned adjacent said inlet opening and having a rigidity exceeding the rigidity of said flexible elements; said jacket having a liquid-phase outlet, said flexible elements having a flexibility that increases toward said liquid-phase outlet; said flexible elements being comprised of loop-shaped members with a midsection secured to said hub, said flexible elements being formed by portions of said loop-shaped members extending away from said midsection; said flexible elements comprising elastic bristles adjacent said inlet opening and having flaccid threads at locations axially spaced from said elastic bristles.

* * * * *